US006516691B1

(12) United States Patent
Wei

(10) Patent No.: US 6,516,691 B1
(45) Date of Patent: Feb. 11, 2003

(54) RACHETING TOOL WITH A TAPERED SPRING POSITIONING MEMBER

(76) Inventor: Hung Yin Wei, No. 2 Lane 235, Yung-Yi Rd., Tai-Ping City, Taichung Hsien (TW)

( * ) Notice: Subject to any disclaimer, the term of this patent is extended or adjusted under 35 U.S.C. 154(b) by 0 days.

(21) Appl. No.: 10/068,896

(22) Filed: Feb. 11, 2002

Related U.S. Application Data

(63) Continuation-in-part of application No. 09/915,318, filed on Jul. 27, 2001, now abandoned.

(51) Int. Cl.[7] ..... B25B 13/46
(52) U.S. Cl. ..... 81/63.2; 81/63
(58) Field of Search ..... 81/60, 61, 62, 81/63, 63.1, 63.2

(56) References Cited

U.S. PATENT DOCUMENTS 1,078,059 A * 11/1913 Mossberg ..... 81/63
2,185,002 A * 12/1939 Pack ..... 81/63
2,735,324 A * 2/1956 Goldwater et al. ..... 81/60
6,237,447 B1 * 5/2001 Chen et al. ..... 81/63.1
6,282,991 B1 * 9/2001 Hu ..... 81/63.2
6,282,993 B1 * 9/2001 Forman et al. ..... 81/63.2

* cited by examiner

*Primary Examiner*—Eileen P. Morgan
*Assistant Examiner*—Joni B. Danganan
(74) *Attorney, Agent, or Firm*—Rosenberg, Klein & Lee

(57) ABSTRACT

A ratchet tool in which a receptacle is formed between the head section and the handle. A ratchet block and a spring are disposed in the receptacle. The top face of the receptacle is formed with a slot communicating with the receptacle and outward passing through the main body of the ratchet tool. The top face of the ratchet block is formed with an insertion section in which a driving block is inlaid. The driving block has a driving rod extending through and out of the slot to screw with a push button. By means of pushing the push button, the driving rod is linearly moved within the slot, whereby the driving block drives the ratchet block to change the wrenching direction of the ratchet tool.

1 Claim, 11 Drawing Sheets

RACHETING TOOL WITH A TAPERED SPRING POSITIONING MEMBER

CROSS-REFERENCE TO RELATED APPLICATION

This application is a Continuation-in-Part application of Ser. No. 09/915,318, filed July 27, 2001, and entitled "RATCHET TOOL", now abandoned.

BACKGROUND OF THE INVENTION

The present invention is related to a ratchet tool which can be two-way switched to easily change the position of the ratchet block.

FIG. 6 shows a conventional two-way ratchet wrench. One end of the wrench is a head section 81 connected with a handle 82. A ratchet 83 is mounted in the head section 81. A tunnel 84 is radially formed at the conjunction between the head section 81 and the handle 82. A ratchet rack 85 is fitted in the tunnel 84. The ratchet rack 85 has two opposite ratchet sections and two dents 853 in which a locating steel bead 86 is pushed by a spring 87 and located. In normal state, the ratchet rack 85 is pushed by the steel bead 86 and the first ratchet section 851 is engaged with the ratchet 83. One end of the ratchet rack 85 extends out of the tunnel 84 for a user to push so as to push the ratchet rack 85 and change the position thereof. At this time, the second ratchet section 852 of the ratchet rack 85 is engaged with the ratchet 83 and the rotational direction of the ratchet wrench is changed.

Such conventional ratchet wrench has some shortcomings as follows:

1. When working, the ratchet 83 of the head section 81 is fitted onto a bolt and the handle 82 is held to wrench the bolt. Accordingly, the stress is concentrated at the conjunction between the head section 81 and the handle 82. However, the conjunction is formed with a tunnel 84 so that the strength of the conjunction is much weakened. Therefore, when wrenching the bolt, the wrench is hard to bear high torque and tends to break at the conjunction.
2. It often takes place that a user needs to operate the wrench in a narrow place. However, one end of the ratchet rack 85 protrudes from the wrench and tends to obstruct the operation when wrenching the wrench. Moreover, the protruding end of the ratchet rack 85 makes it quite inconvenient to fit the wrench onto the bolt.

FIGS. 7 to 10 show another type of conventional ratchet wrench 9. The conjunction between the head section 91 and the handle 92 is formed with a receptacle 94 in which a ratchet block 93 is mounted. The receptacle 94 communicates with a socket 941 outward extending from the receptacle 94 through the wrench 9. The socket 941 has a dent 942 formed on a side wall of the socket 941. A driving block 95 is placed in the socket 941 and partially protrudes beyond the wrench 9 for a user to shift. A spring 97 is fitted around one end of a driving pin 96 which is fitted in a hole 952 of the driving block 95. The other end of the driving pin 96 abuts against the wall of a recess 931 formed on the bottom of the ratchet block 93 as shown in FIG. 9. One end of the spring 97 is finer, while the other end thereof is coarser. The rearmost end of the coarser end is enlarged to lean on outer side of the hole 952. The free end of the finer end has a radially extending restricting bar 971 for abutting against and locating the driving pin 96. One end of a locating pin 98 abuts against one end of the dent 942, while the other end thereof is fitted in a spring 99 and inserted in a hole 953 of the driving block 95.

When shifting the driving block 95, the rear end of the locating pin 98 is moved from one end of the dent 942 to the other end thereof. The driving pin 96 is driven by the driving block 95 to move the ratchet block 93 to the other side so as to change the wrenching direction of the wrench 9. The above conventional ratchet wrench 9 has some shortcomings as follows:

1. When shifting the driving block 95, the driving block 95 is rotated about a fixed fulcrum to drive the locating pin 98 and the driving pin 96. It is necessary for the user to overcome a resistant force for rotating the driving block 95. Therefore, it is not so easy to rotate the driving block 95.
2. As shown in FIG. 9, a spring 97 is fitted around the bottom end of the driving pin 96, while the top end of the driving pin 96 directly abuts against the ratchet block 93. The driving pin 96 itself has no resilience so that it is hard for the driving pin 96 to drive the ratchet block 93.
3. One end of the spring 97 is finer, while the other end thereof is coarser. In addition, the free end of the finer end has a radially extending restricting bar 971.

Therefore, it is troublesome to manufacture the spring 97.

SUMMARY OF THE INVENTION

It is therefore a primary object of the present invention to provide a ratchet tool in which the driving block can be easily shifted to change the position of the ratchet block. One side of the receptacle receiving the ratchet block is formed with a slot communicating with the receptacle and outward passing through the main body of the ratchet tool. A driving block is inlaid in the ratchet block. The driving block has a driving rod extending through and out of the slot to connect with a push button disposed on outer side of the main body. When pushing the push button, the driving rod is linearly moved within the slot, whereby the driving block drives the ratchet block to change the wrenching direction of the ratchet tool.

It is a further object of the present invention to provide the above ratchet tool in which the section of the driving rod extending out of the slot is a threaded section for screwing with the push button. By means of pushing the push button, the driving block can be easily switched.

It is still a further object of the present invention to provide the above ratchet tool in which the middle of the cavity is straight and not arched. Therefore, two ends of the cavity are farther from the leaning section of the spring, whereby the spring will push two ends of the cavity to move the ratchet block. This makes the ratchet block more truly located.

It is still a further object of the present invention to provide the above ratchet tool in which two ends of the spring are both tapered so that the contacting area between two ends of the spring and the leaning section and the cavity is reduced. This reduces the resistance against the shifting of the spring. Therefore, the ratchet block can be easily switched.

The present invention can be best understood through the following description and accompanying drawings wherein:

DETAILED DESCRIPTION OF THE PREFERRED EMBODIMENT

Figure 1:
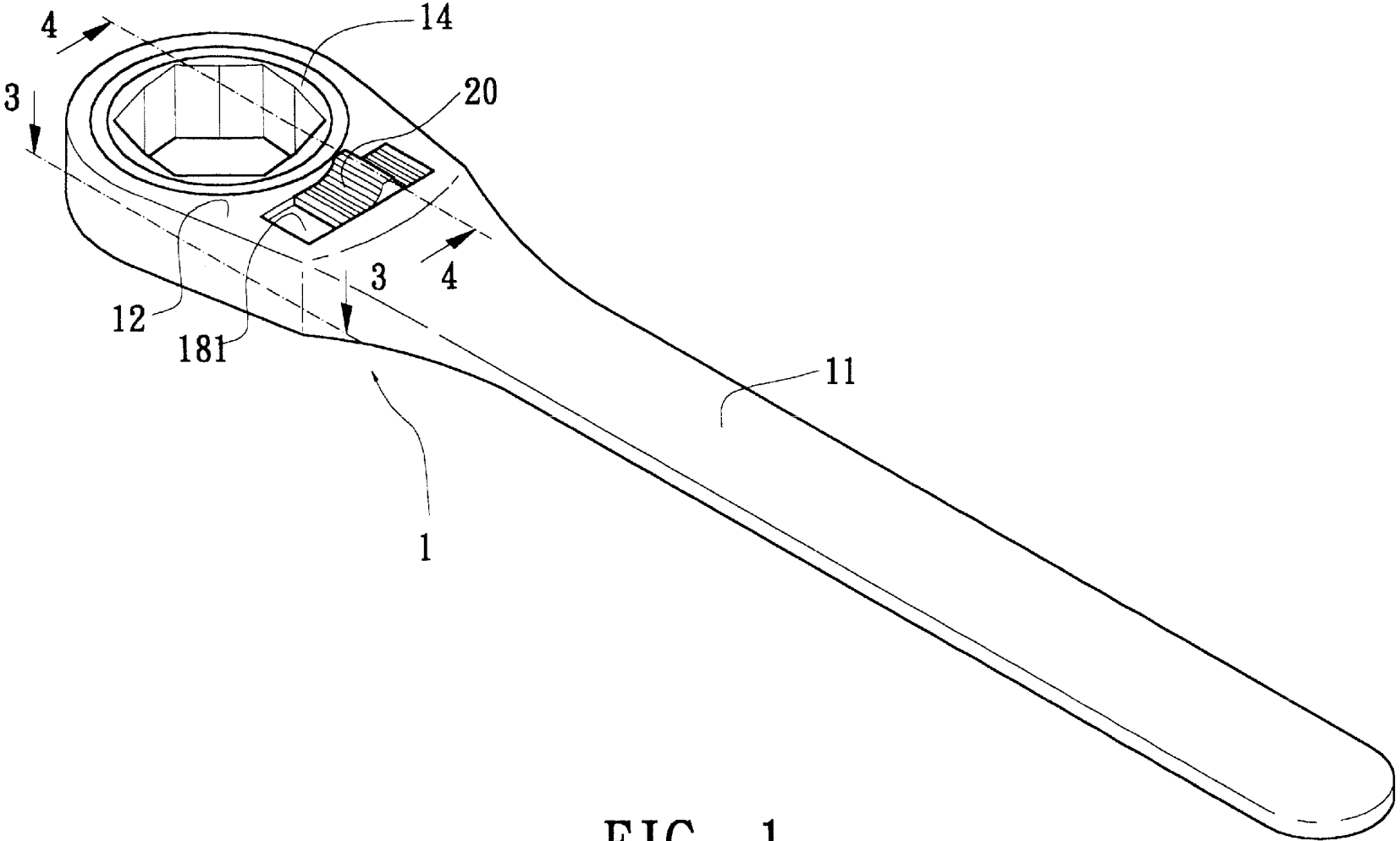
FIG. 1 is a perspective assembled view of the present invention.
Figure 2:
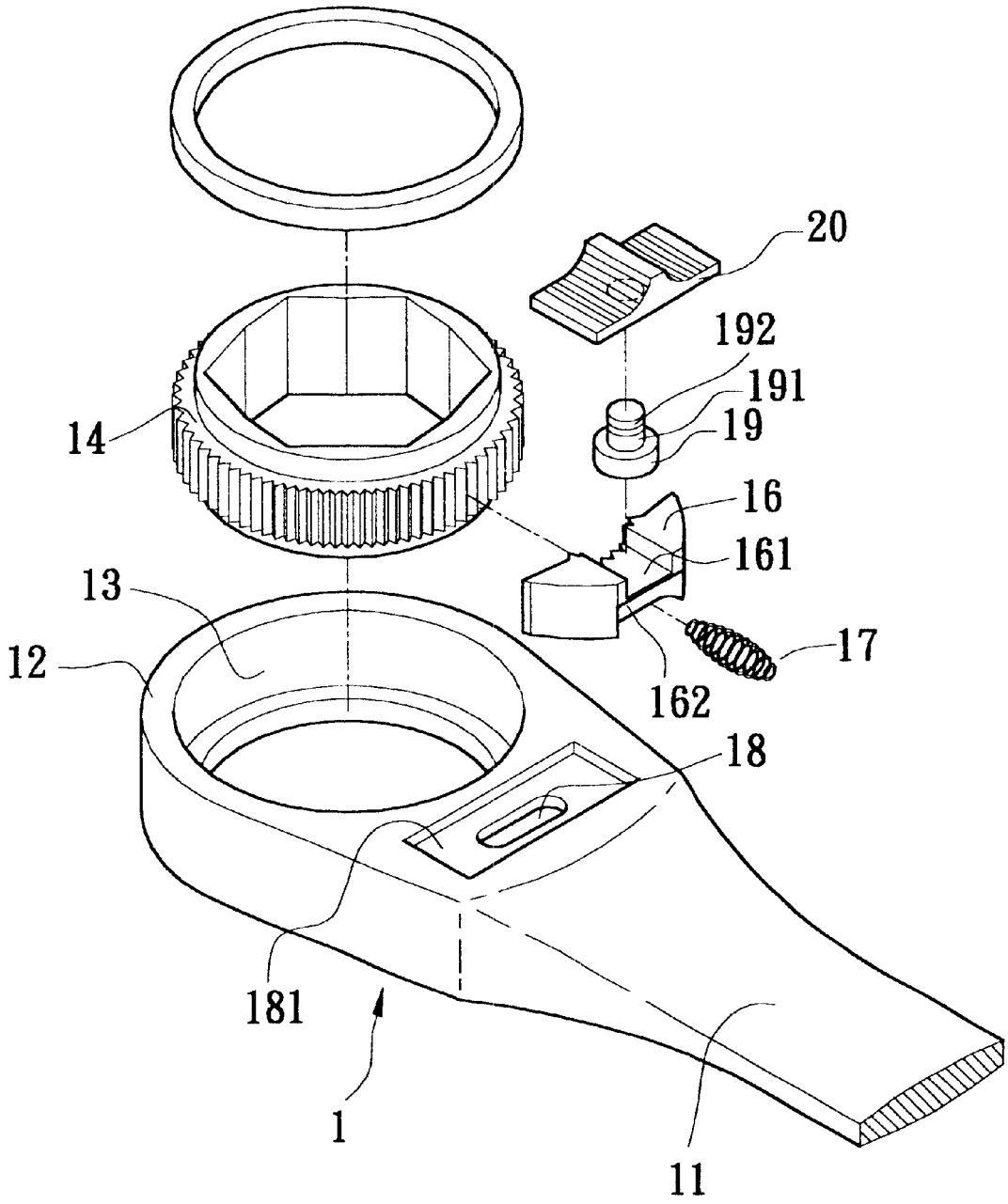
FIG. 2 is a perspective exploded view of the present invention.
Figure 3:
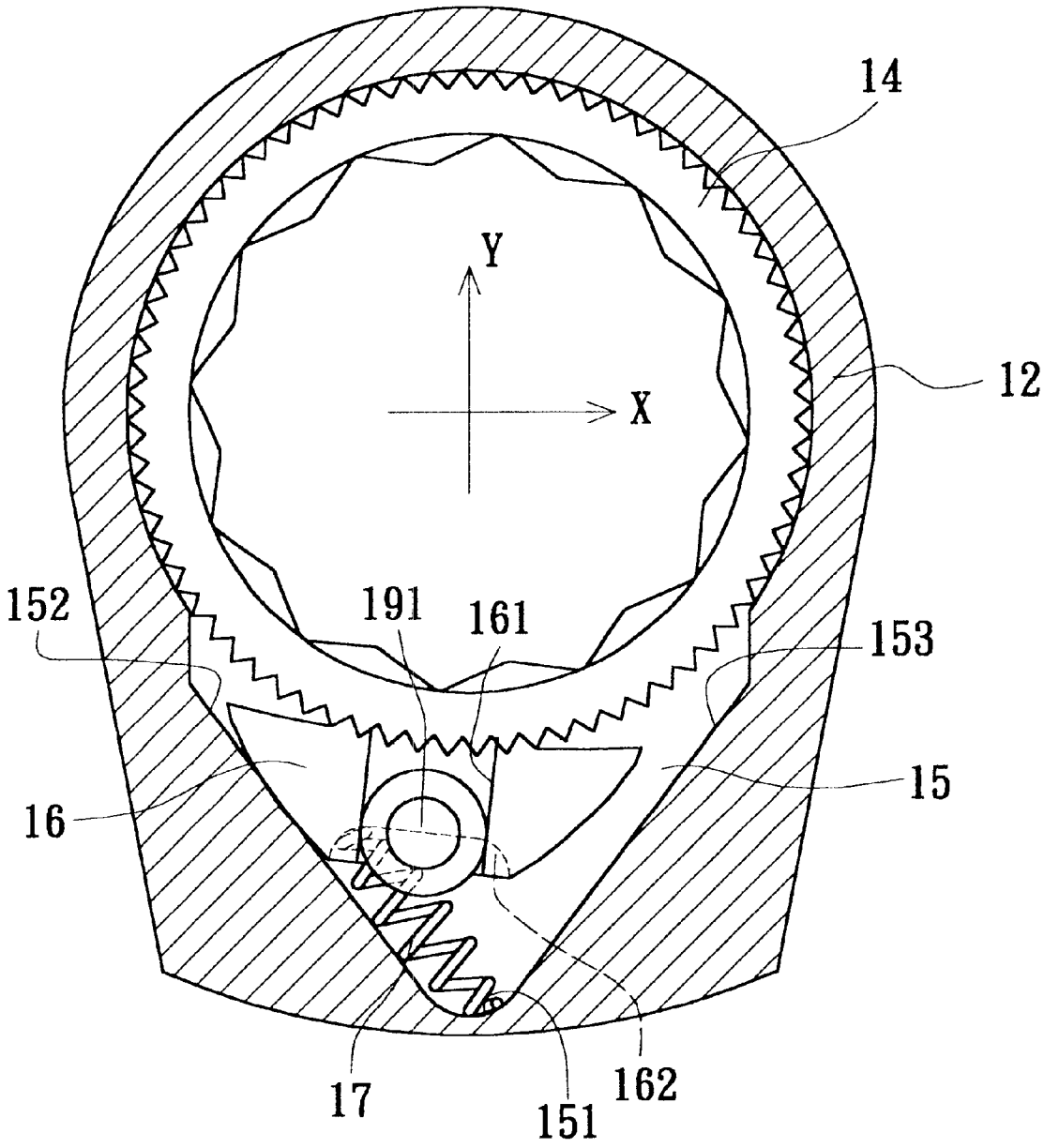
FIG. 3 is a sectional view taken along line 3—3 of FIG. 1.
Figure 4:
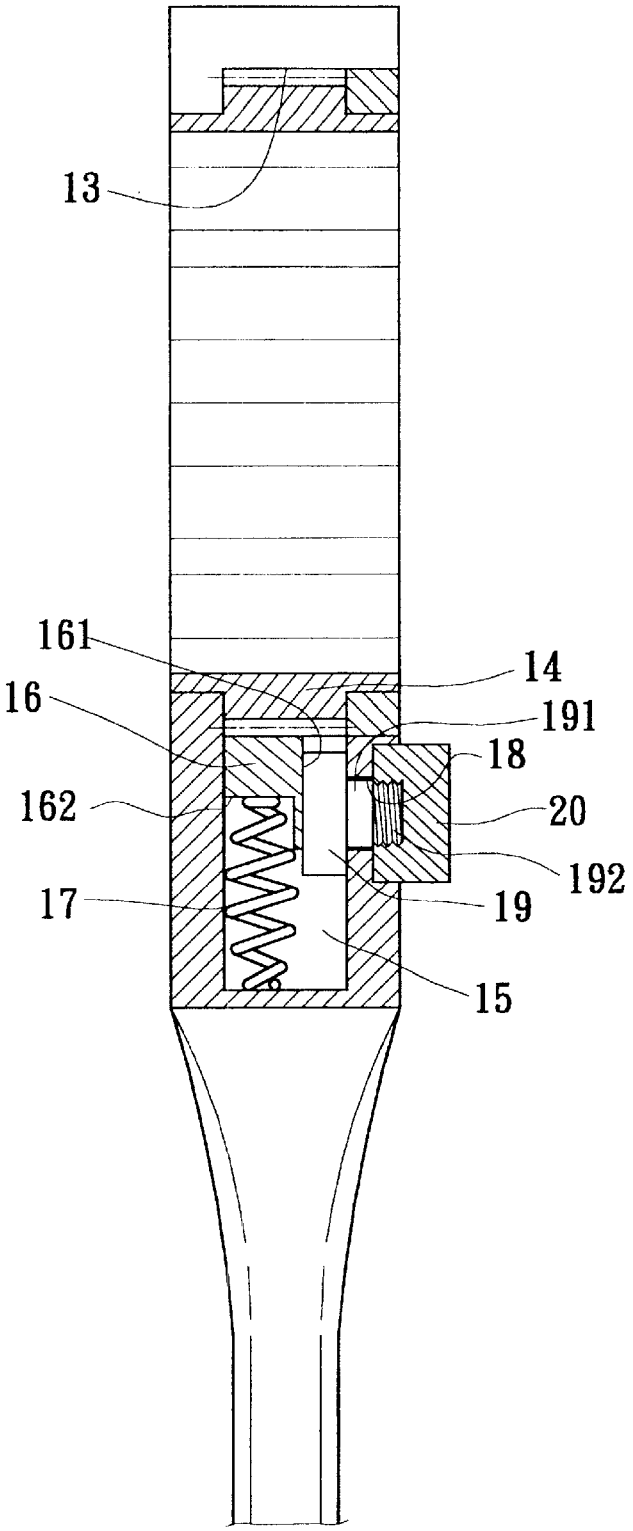
FIG. 4 is a sectional view taken along line 4—4 of FIG. 1.

Please refer to FIGS. 1 to 4. The ratchet tool of the present invention includes a main body 1 having a handle 11. One end of the handle 11 has a head section 12 formed with a ratchet cavity 13 for receiving therein a ratchet 14. Referring to FIG. 3, the head section 12 is defined to have an X axis and a Y axis. A receptacle 15 is formed between the head section 12 and the handle 11. The receptacle 15 is open to the head section 12. The bottom of the receptacle 15 is formed with an arched leaning section 151. The leaning section 151 radially diverges toward the head section 12 to form two stop faces 152, 153. A ratchet block 16 and a spring 17 are disposed in the receptacle 15. Two ends of the spring 17 are both tapered. One end of the spring 17 abuts against the leaning section 151, while the other end thereof pushes the ratchet block 16 to engage with the ratchet 14. The top face of the receptacle 15 is formed with a slot 18 extending along X axis and communicating with the receptacle 15. A section of the slot 18 on outer face of the main body 1 is enlarged to form a slide channel 181.

One side of the ratchet block 16 facing the leaning section 151 is formed with a cavity 162. The middle of the cavity 162 is straight. Two ends of the cavity 162 are farther from the leaning section 151, whereby the spring 17 will push two ends of the cavity 162 to move the ratchet block 16. The top face of the ratchet block 16 is formed with a recess 161 in which a driving block 19 is inlaid. The width of the recess 161 in X axis direction is equal to the diameter of the driving block 19. The recess 161 passes through the ratchet block 16 along Y axis. The driving block 19 has a small diameter driving rod 191 passing through the slot 18. The section of the driving rod 191 extending out of the slot 18 is a threaded section 192 for screwing with a push button 20 disposed in the slide channel 181 for a user to shift.

Figure 5A:
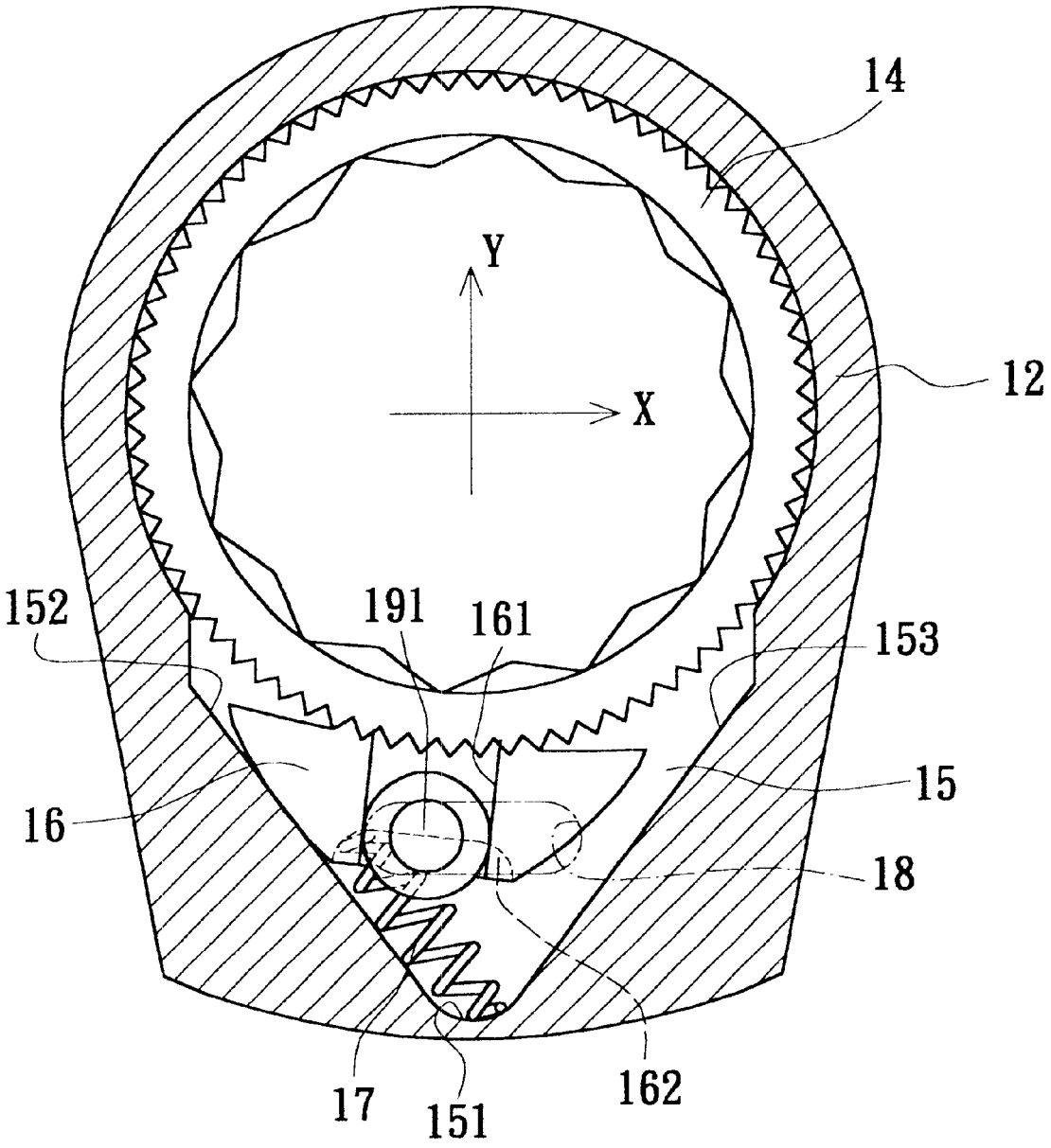
FIGS. 5*a* and 5*b* show that the driving block and the ratchet block are moved.
Figure 5B:
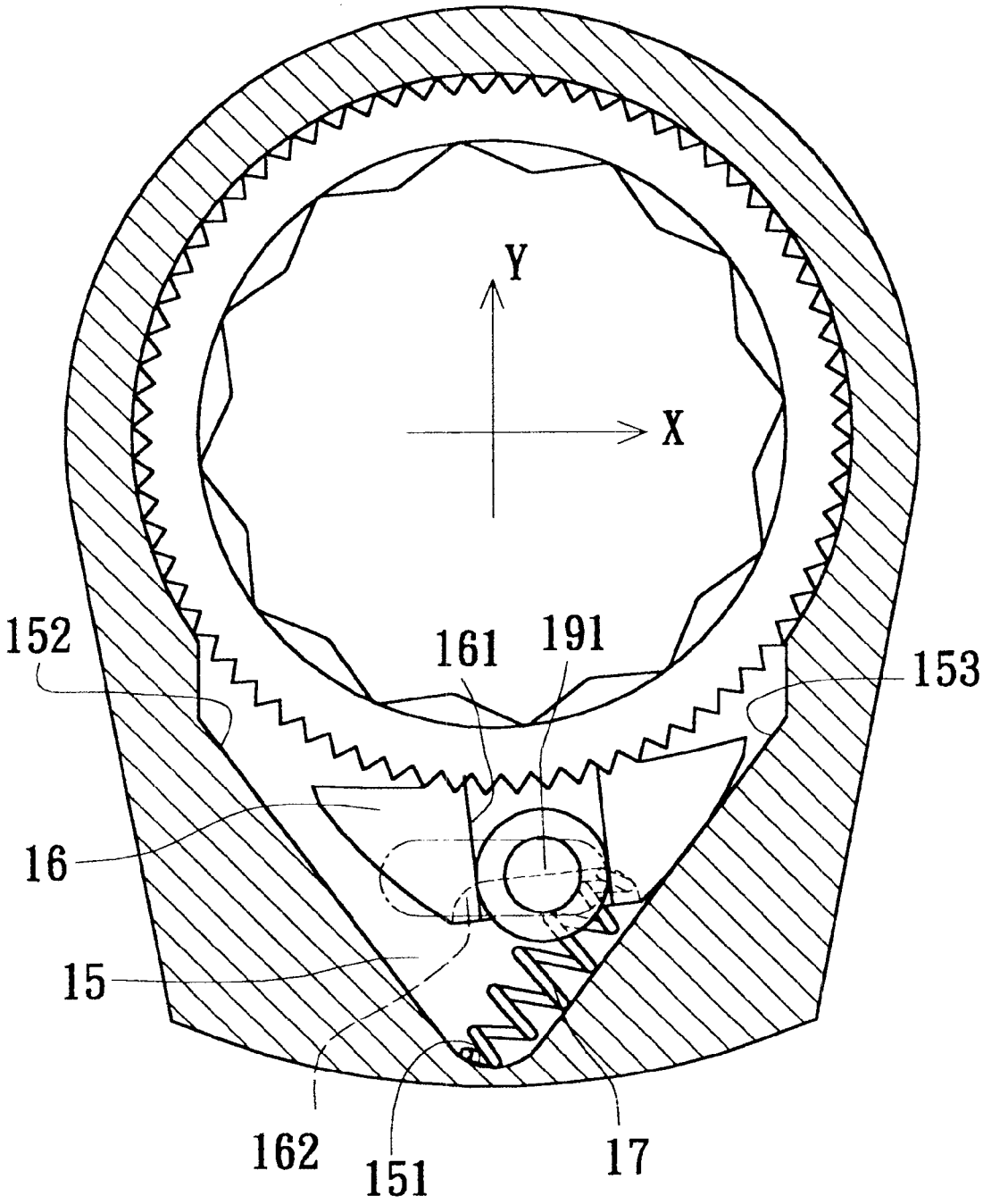
Figure 6:
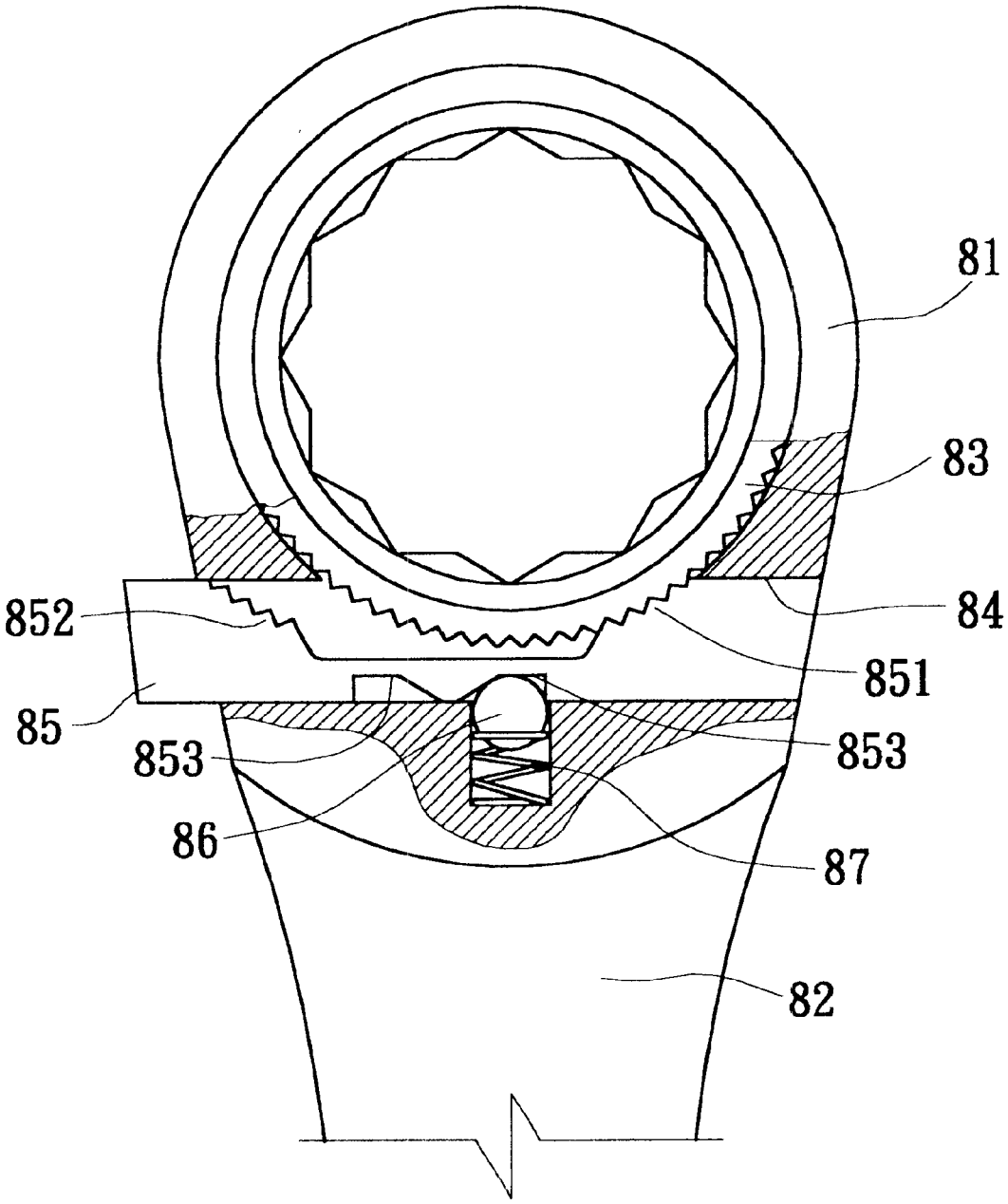
PRIOR ART FIG. 6
FIG. 6 is a sectional view of a conventional ratchet wrench.
Figure 7:
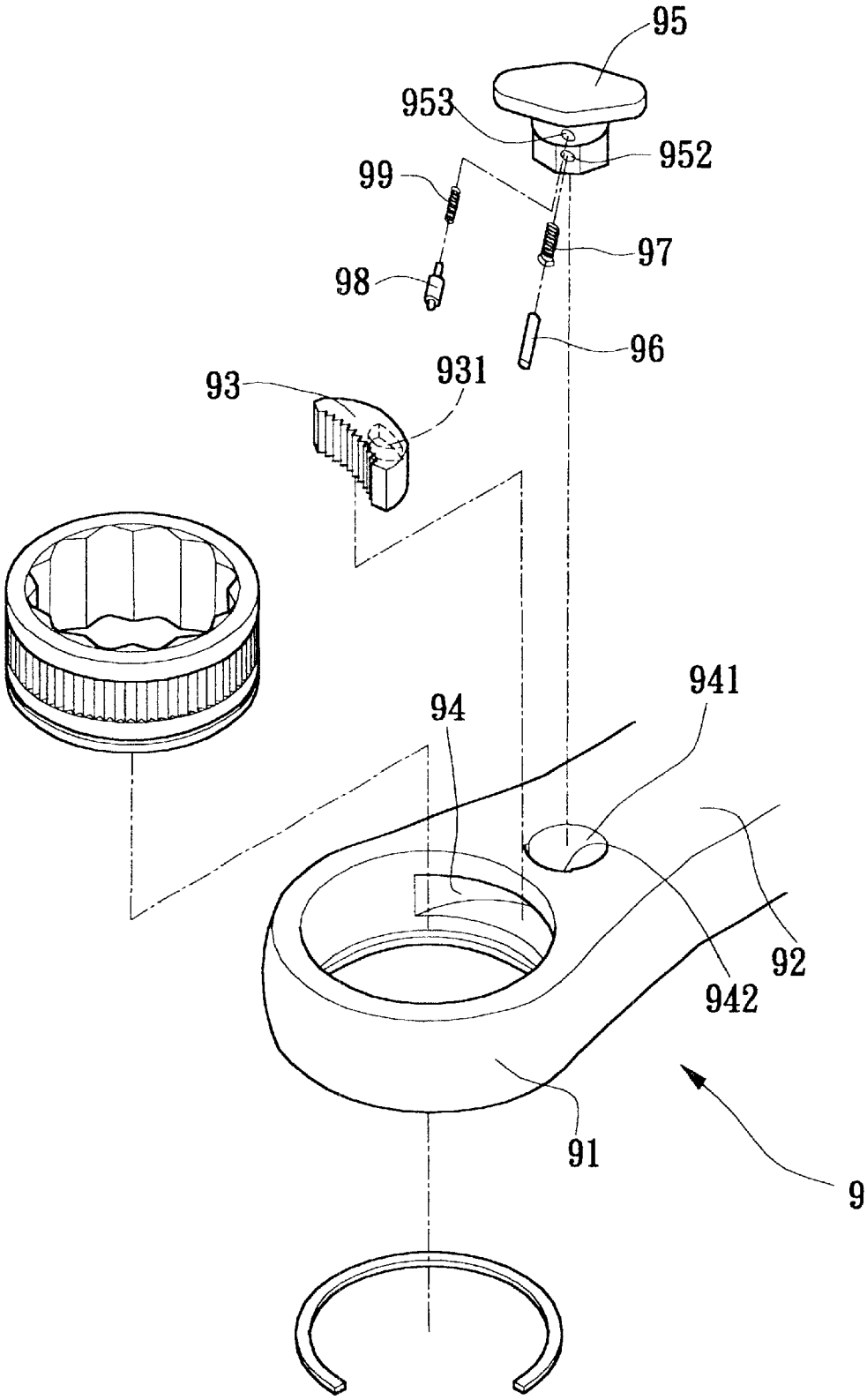
PRIOR ART FIG. 7
FIG. 7 is a perspective view of another type of conventional ratchet wrench.
Figure 8:
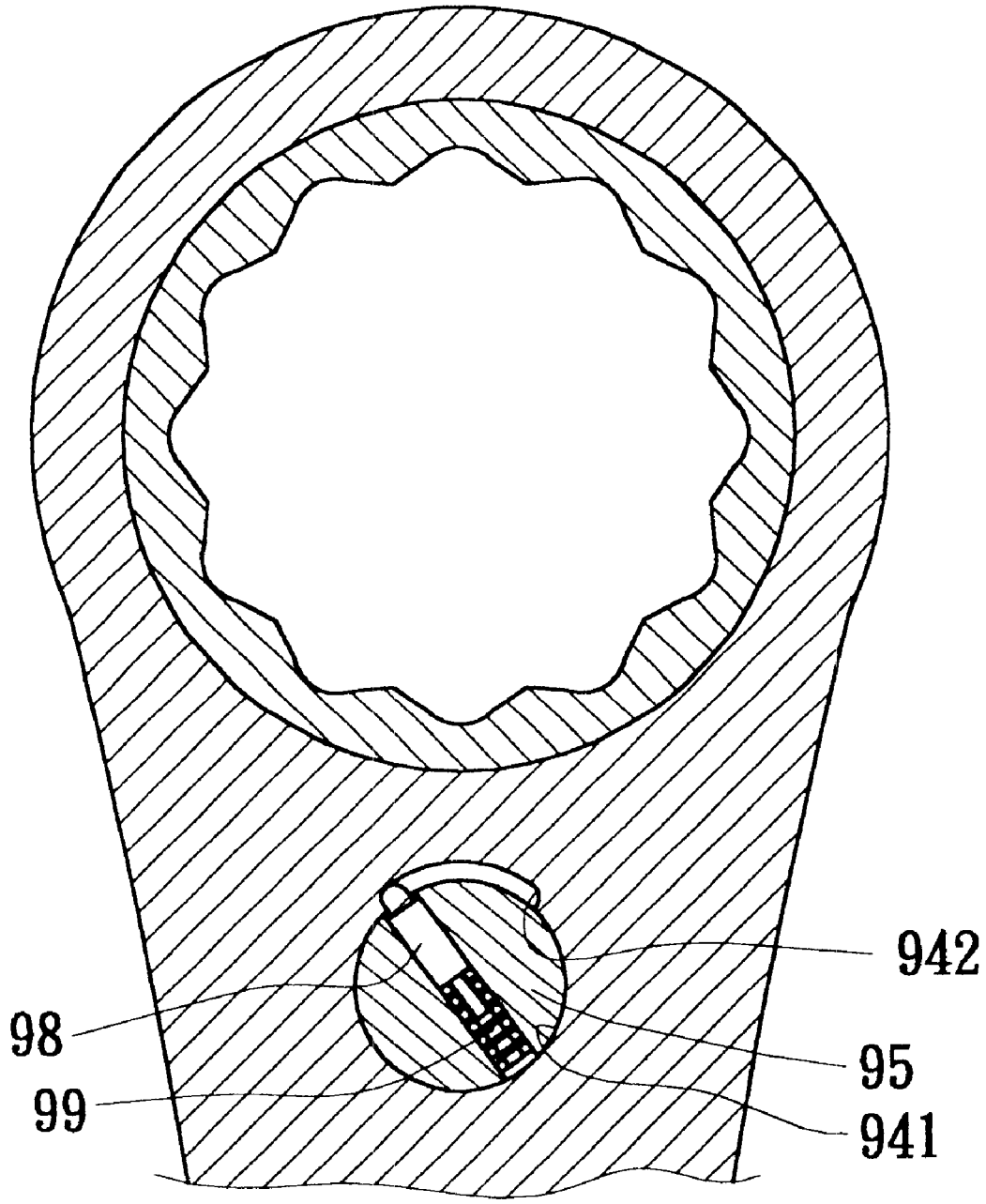
PRIOR ART FIG. 8
FIG. 8 shows the relationship between the locating pin and dent of the ratchet wrench of FIG. 7.
Figure 9:
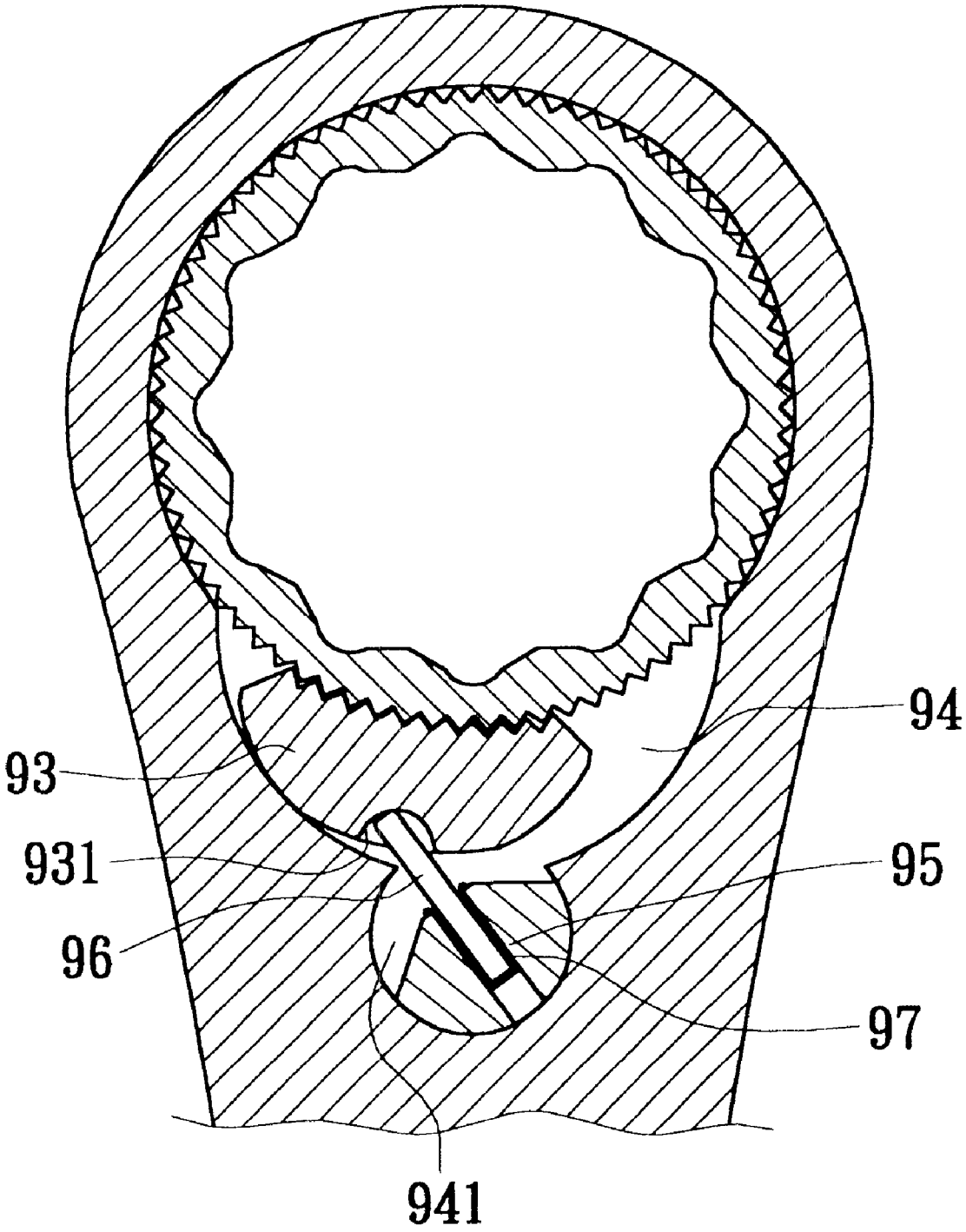
PRIOR ART FIG. 9
FIG. 9 shows that the driving pin drives the ratchet block of the ratchet wrench of FIG. 7.
Figure 10:
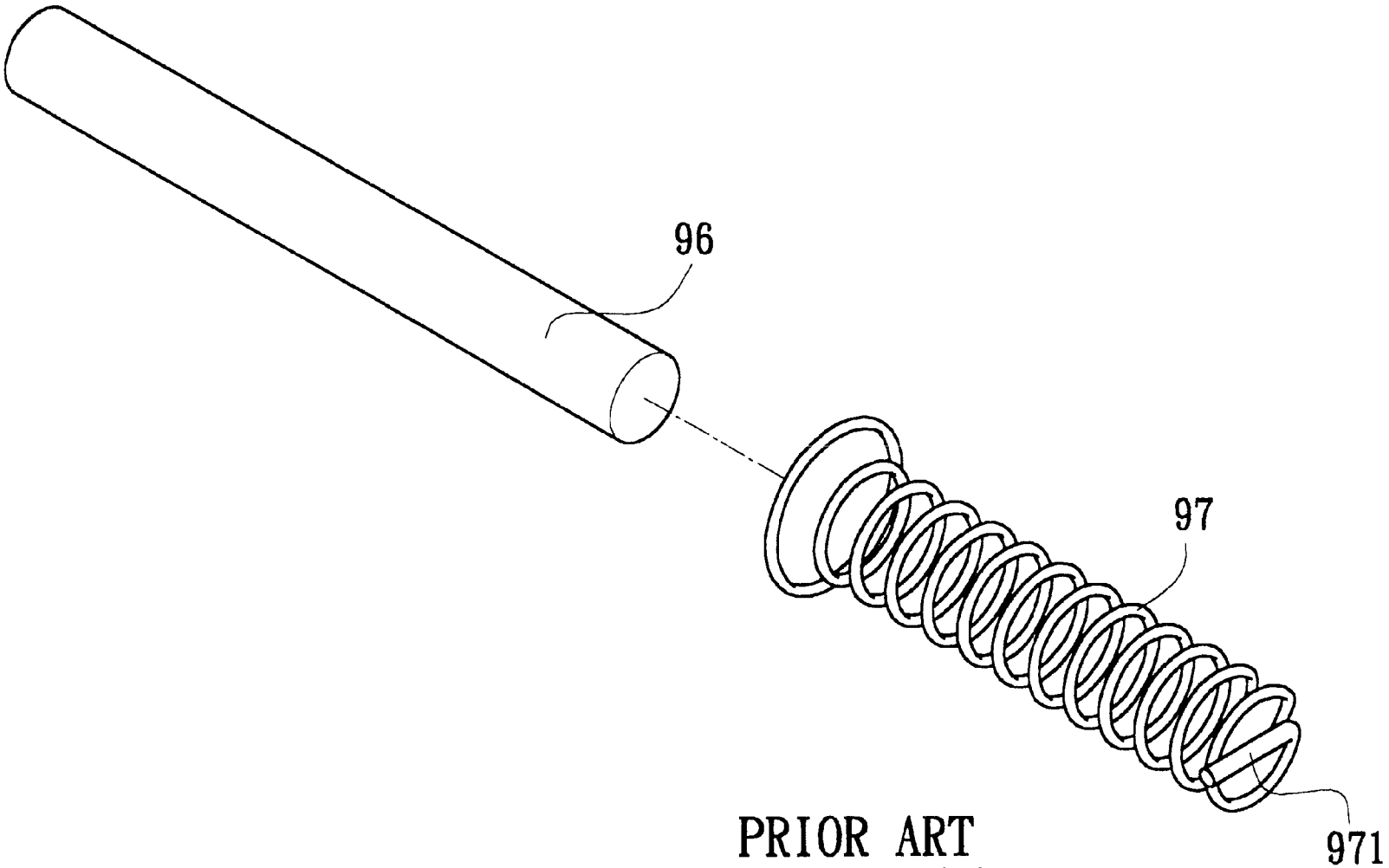
PRIOR ART FIG. 10
FIG. 10 is an enlarged view of the spring of the ratchet wrench of FIG. 7.

Referring to FIG. 5*a*, in normal state, the spring 17 will abut against one end of the cavity 162 to further push the ratchet block 16 to make one side of the ratchet block 16 lean against the stop face 152 and make the ratchets of the ratchet block 16 engaged with the ratchet 14. At this time, the ratchet tool can be wrenched in a specific direction. As shown in FIGS. 5*a* and 5*b*, when shifting the driving rod 191, the driving pin 191 is linearly moved within the slot 18. The driving block 19 is inlaid in the recess 161 of the ratchet block 16 so that the driving block 19 will drive the ratchet block 16 to move. The ratchet block 16 is engaged with the ratchet 14 so that the ratchet block 16 will compress the spring 17 along the arched profile of the ratchet 14. However, when the ratchet block 16 further moves along the arched profile of the ratchet 14, the spring 17 will restore from a compressed state to start extending to push the ratchet block 16. When the driving block 19 is moved to the rightmost side, the ratchet block 16 will lean on the other side of the receptacle 15 and the spring 17 will resiliently extend to push the ratchet block 16 and abut against the cavity 162 so as to firmly locate the ratchet block 16 and change the wrenching direction of the ratchet tool.

According to the above arrangement, the driving block 19 is directly inlaid in the ratchet block 16 and the driving block 19 is screwed with the push button 20 so that a user can push the push button 20 to make the driving block 19 drive the ratchet block 16 and change the position thereof so as to easily change the wrenching direction of the ratchet tool. The driving rod 191 is limited within the slot 18 and can be only linearly moved so that it is unnecessary to overcome any resistant force for shifting the driving block.

In addition, when the ratchet block 16 abuts against the stop faces 152, 153, they contact with each other on a face so that the ratchet block 16 can firmly lean on the stop faces 152, 153. The middle of the cavity 162 of the ratchet block 16 is straight and not arched so that two ends of the cavity 162 are farther from the leaning section, whereby the spring 17 will push two ends of the cavity 162 to move the ratchet block 16. The spring 17 abuts against the cavity 162 and is stopped by the lateral faces of the cavity 162. Therefore, the spring 17 can firmly abut against the ratchet block 16. The other end is leant against the leaning section 15 so that the spring 17 can firmly push the ratchet block 16 without displacement. Accordingly, when working with the ratchet tool, the ratchet tool can bear high torque and the ratchet block 16 will not move. In addition, two ends of the spring 17 are both tapered so that the contacting area between two ends of the spring 17 and the leaning section 151 and the cavity 162 is reduced. This reduces the resistance against the shifting of the spring 17. Therefore, the resistance against the ratchet block 16 driven by the driving block 19 is reduced and the ratchet block 16 can be easily switched.

Furthermore, the recess 161 passes through the ratchet block 16 in Y axis direction so that when the ratchet block 16 is driven and moved by the driving block 19, the movement of the ratchet block 16 in Y axis direction is not limited. Therefore, when the ratchet block 16 is driven by the driving block 19, the ratchet block 16 itself can cooperate with the ratchet 14 to move along an arched path without limitation. Therefore, a user can easily shift the driving rod 191 so as to change the wrenching direction of the ratchet tool. According to the above, the present invention has the following advantages:

1. The driving block 19 is directly inlaid in the ratchet block 16. The driving block 19 is connected with a push button 20 disposed on outer side of the main body 1 and can be only linearly moved within the slot. Therefore, the driving block 19 can be easily shifted to drive the ratchet block 16 to change the wrenching direction of the ratchet tool.
2. The middle of the cavity 162 of the ratchet block 16 is straight and not arched so that two ends of the cavity 162 are farther from the leaning section, whereby the spring 17 will push two ends of the cavity 162 to move the ratchet block 16. This makes the ratchet block 16 more truly located.
3. Two ends of the spring 17 are both tapered so that the contacting area between two ends of the spring 17 and the leaning section 151 and the cavity 162 is reduced. This reduces the resistance against the shifting of the spring 17. Therefore, the ratchet block 16 can be easily switched.

The above embodiment is only used to illustrate the present invention, not intended to limit the scope thereof. Many modifications of the above embodiment can be made without departing from the spirit of the present invention.

What is claimed is:

1. A ratchet tool comprising:

a main body having a handle, one end of the handle having a head section formed with a ratchet cavity, the main body having a slide channel formed in as top face thereof;

a ratchet received in the ratchet cavity;

a receptacle formed between the and the handle, the receptacle being open to the ratchet cavity on one end thereof and having a leaning section formed on an opposing end, the receptacle having a pair of radially diverging stop faces extending from the leaning section toward the ratchet cavity, the slide channel having a slot formed therein in open communication with the receptacle;

a ratchet block disposed in the receptacle and having a longitudinally extended cavity formed in a rear end thereof and a top face formed with an insertion section;

a spring disposed in the receptacle and having two tapered ends for pushing the ratchet block into engagement with the ratchet, a first on the ends abutting the leaning section and the second end being disposed in the cavity of the ratchet block;

a driving block disposed in the insertion section of the ratchet block and having a driving rod extending through the slot, the driving rod having a threaded section formed thereon; and a push button disposed in the slide channel and coupled to the threaded section of the drive rod for lineraly displacing the drive rod within the slot and thereby displace the ratchet block to abut a selected one of the stop faces to change a ratcheting direction of the ratchet tool.

* * * * *